US008935869B2

(12) United States Patent
Aires

(10) Patent No.: US 8,935,869 B2
(45) Date of Patent: Jan. 20, 2015

(54) DUAL ARM SIGN

(76) Inventor: Gary Dean Aires, San Diego, CA (US)

( * ) Notice: Subject to any disclaimer, the term of this patent is extended or adjusted under 35 U.S.C. 154(b) by 0 days.

(21) Appl. No.: 13/716,118

(22) PCT Filed: Jul. 30, 2010

(86) PCT No.: PCT/US2010/044000

§ 371 (c)(1),
(2), (4) Date: Dec. 15, 2012

(87) PCT Pub. No.: WO2012/015436

PCT Pub. Date: Feb. 2, 2012

(65) Prior Publication Data

US 2013/0263485 A1 Oct. 10, 2013

(51) Int. Cl.

| | |
|---|---|
| ***G09F 17/00*** | (2006.01) |
| ***G09F 7/00*** | (2006.01) |
| ***G09F 7/22*** | (2006.01) |
| ***G09F 15/00*** | (2006.01) |
| *G09F 7/18* | (2006.01) |

(52) U.S. Cl.

CPC .. *G09F 7/00* (2013.01); *G09F 7/22* (2013.01); *G09F 15/0025* (2013.01); *G09F 15/0087* (2013.01); *G09F 2007/1886* (2013.01)

USPC ..... 40/603; 116/173

(58) Field of Classification Search

USPC ..... 40/603, 604, 610, 607.05, 586; 116/174, 173; 38/102.1, 102.8; D20/41

See application file for complete search history.

(56) References Cited

U.S. PATENT DOCUMENTS

| | | | | |
|---|---|---|---|---|
| 6,332,284 | B1 * | 12/2001 | Tafforeau | 40/603 |
| 7,424,864 | B2 * | 9/2008 | McCann | 116/174 |
| 2006/0130380 | A1 * | 6/2006 | Aires | 40/603 |
| 2008/0236009 | A1 * | 10/2008 | Venn | 40/606.12 |
| 2009/0183408 | A1 | 7/2009 | Dicke | |
| 2010/0037499 | A1 * | 2/2010 | Hyung-Chul | 40/606.01 |

FOREIGN PATENT DOCUMENTS

| | | | |
|---|---|---|---|
| KR | 200399546 | Y | 10/2005 |
| WO | 03083813 | B1 | 12/2003 |

* cited by examiner

*Primary Examiner* — Joanne Silbermann
(74) *Attorney, Agent, or Firm* — Paul D. Chancellor; Ocean Law

(57) ABSTRACT

A dual arm sign includes an upstanding panel stretched between resilient arms.

13 Claims, 8 Drawing Sheets

DUAL ARM SIGN

PRIORITY CLAIM

This application is a continuation of international application number PCT/US2010/044000 filed 30 Jul. 2010.

BACKGROUND OF THE INVENTION

1. Field of the Invention

The present invention relates to an article of manufacture. In particular, a pair of arms supports a panel.

2. Discussion of the Related Art

Commonplace signage is typically rigid and not easily moved. Signage like this often fails in its main purpose, to attract attention and with it the opportunity to convey a message such as an advertising message. Evidence of this failure is the rising use of human carried, human held signs where human animation first draws the attention of bystanders and passersby. That humans are affordable as sign bearers is surely a temporary phenomenon in the United States. What is needed is an affordable sign that attracts attention without human involvement and capitalizes on the opportunity to present a message.

SUMMARY OF THE INVENTION

A flexible panel suitable for use as a sign is supported by two resilient arms. In an embodiment, a sign comprises first and second resilient arms, the arms flanking a panel substantially in the shape of an upstanding oval. The arms are operable to apply stretching forces to the panel and, at an end of the panel, a yoke applies moments to adjacent ends of the arms. Generally opposed to the yoke end of the panel is a free end of the panel. The stiffness of each arm is greater near the yoke than near the free end of the panel.

BRIEF DESCRIPTION OF THE DRAWINGS

The present invention is described with reference to the accompanying figures. These figures, incorporated herein and forming part of the specification, illustrate embodiments of the invention and, together with the description, further serve to explain its principles enabling a person skilled in the relevant art to make and use the invention.

DETAILED DESCRIPTION OF THE PREFERRED EMBODIMENTS

The disclosure provided in the following pages describes examples of some embodiments of the invention. The designs, figures, and description are non-limiting examples of the embodiments they disclose. For example, other embodiments of the disclosed device and/or method may or may not include the features described herein. Moreover, disclosed advantages and benefits may apply to only certain embodiments of the invention and should not be used to limit the disclosed invention.

As used herein, the term "coupled" includes direct and indirect connections. Moreover, where first and second devices are coupled, interposed devices including active devices may be located therebetween.

Figure 1:
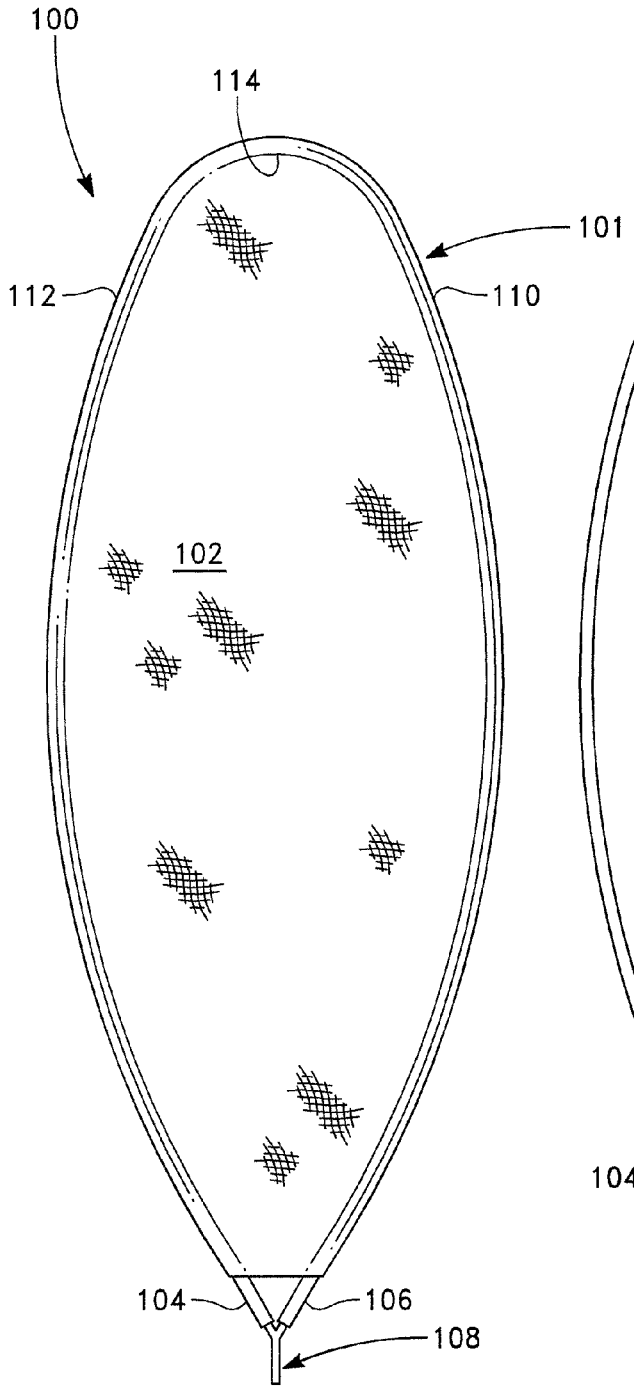
FIG. 1 shows a dual arm sign in accordance with the present invention.

FIG. 1 shows a dual arm sign in accordance with the present invention 100. First and second arms 104, 106 flank at least a portion of a central web 102. The web, together with first and second web couplings 112, 110, form a panel 101 that is suspended by the arms. The couplings provide for transferring forces between the arms and the web. In various embodiments, the couplings include one or more of discontinuous couplings such as discontinuous attachments, straps or sleeves and continuous couplings such as continuous attachments or sleeves. In an embodiment, first and second substantially continuous sleeves provide for coupling the first and second arms to the web (as shown).

Figure 2:
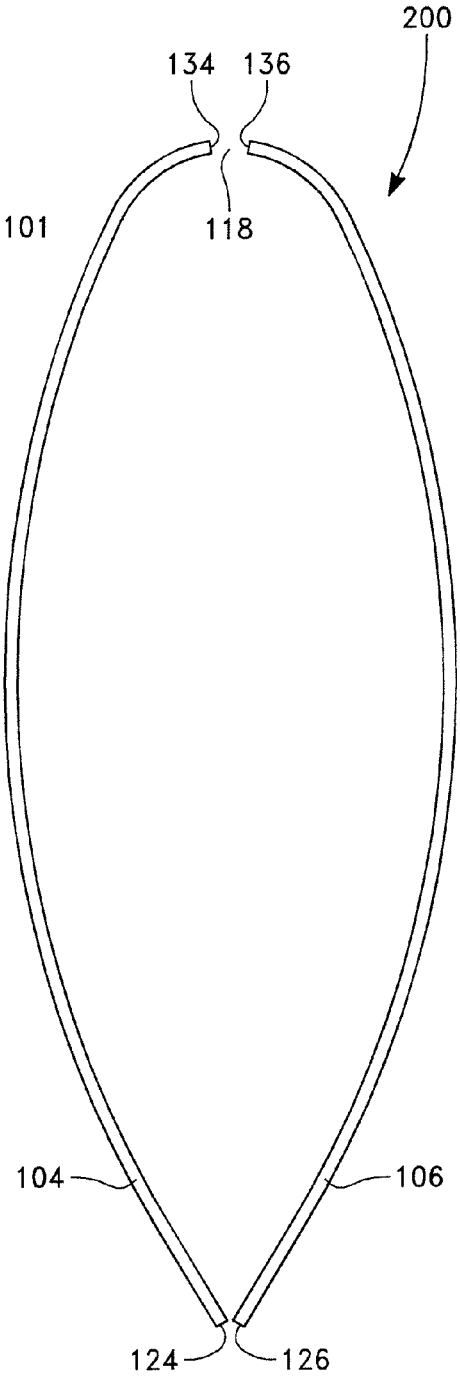
FIG. 2 shows the arms of the sign of FIG. 1 bowed under the influence of applied forces.

FIG. 2 shows the arms bowed under the influence of applied forces 200. Bowing forces are applied to the arms by the web 102 and by a yoke 108. In various embodiments, the upper ends of the arms 134, 136 are generally opposed 118 near a high point of the web 114. Generally opposed to the yoke end of the panel is a free end of the panel.

Figure 7:
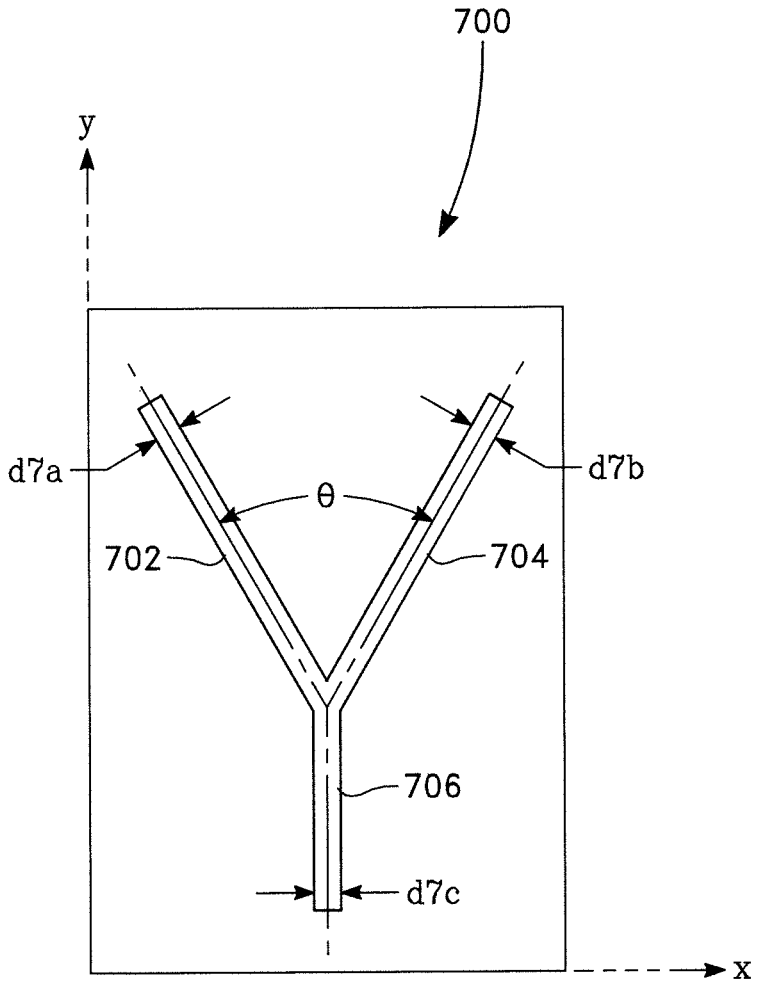
FIG. 7 shows an embodiment of a yoke for use with the dual arm sign of FIG. 1.

As seen in FIGS. 1 and 2, a lower end of each arm 124, 126 is coupled to a respective upraised yoke connector 702, 704 (See FIG. 7). In various embodiments, the yoke connectors bear moments imposed by the arms 104, 106. In some embodiments, the yoke connections receive the lower ends of the arms and in some embodiments the yoke connections are received by the lower ends of the arms (as shown). As persons of ordinary skill in the art will appreciate, the yoke may, in various embodiments, have solid, hollow or both types of connectors. In an embodiment, the upraised yoke connectors are solid and the lower connector is hollow.

In various embodiments, the arms have varying stiffness along their length. And, in various embodiments arm stiffness increases moving from arm tip to arm base (yoke end). Each of the stepped and tapered designs presented below provides a means for varying arm stiffness.

Figure 3:
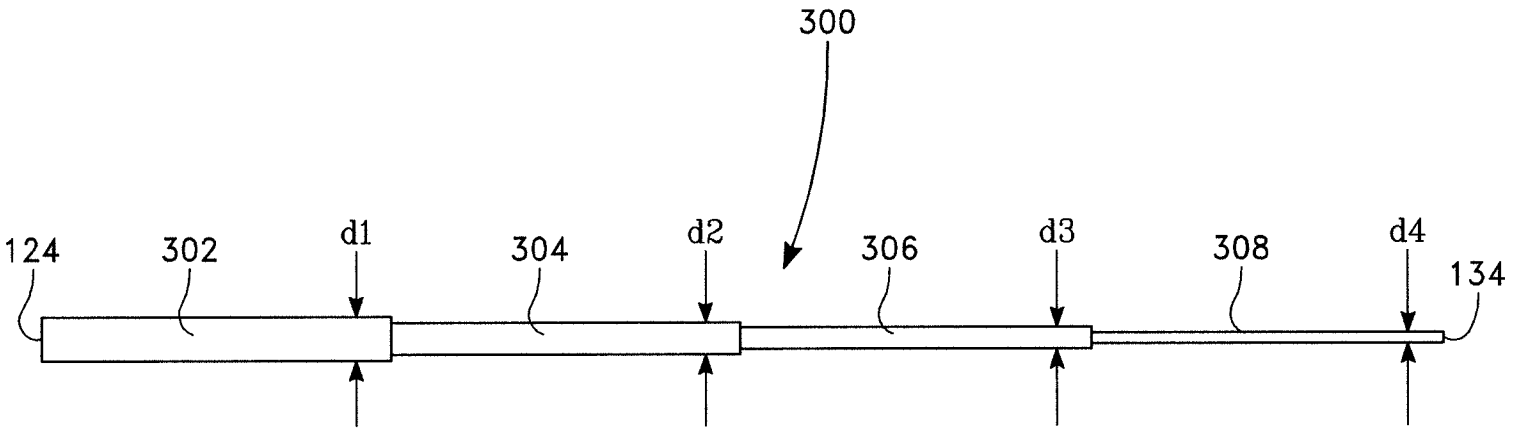
FIG. 3 shows an embodiment of the arms of the sign of FIG. 1.

FIG. 3 shows a stepped arm design 300. The arm includes multiple sections. For example, the arm shown has four sections 302, 304, 306, 308 whose respective outer diameters d1, d2, d3, d4 generally decrease ($d4<d1$) when moving from the arm's lower end 124 to the arm's upper end 134. Other embodiments may use more or fewer sections. In some embodiments the sections are of a telescoping design and, in some embodiments, the section ends are suitably designed as male/female fittings for joining the sections. In various embodiments, the arm is elongated and has a generally circular outer diameter.

Figure 4:
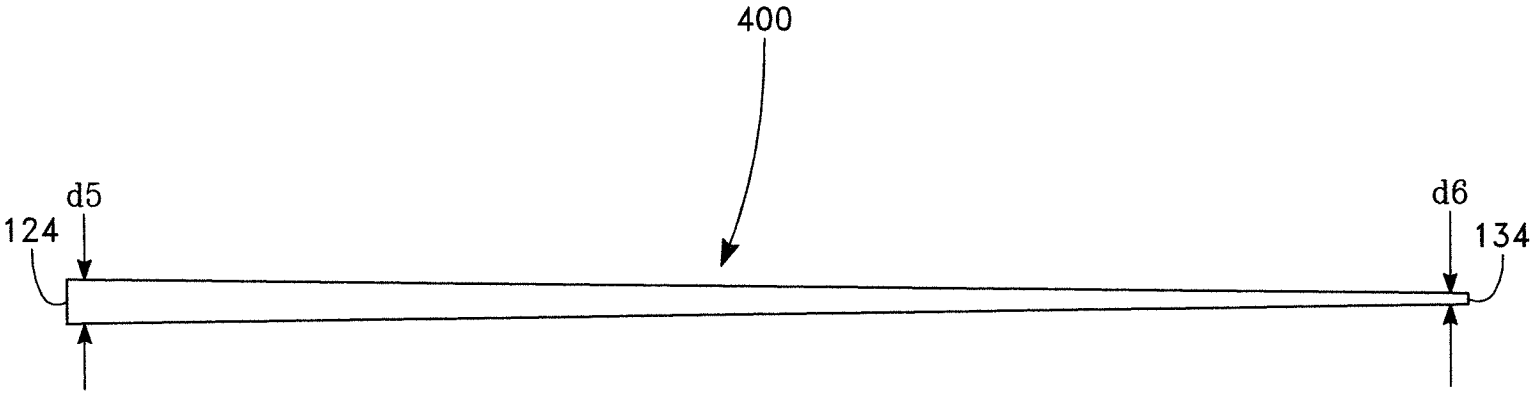
FIG. 4 shows another embodiment of the arms of the sign of FIG. 1.

FIG. 4 shows a conical arm design 400. For example, the arm shown has a substantially continuous taper from the arm's lower end 124 to the arm's upper end 134 and the arm's upper end diameter d6 is less than the lower end diameter d5. In some embodiments, the direction of the taper is not continuous. In various embodiments, the arm is elongated and has a generally circular outer diameter.

Figure 5:
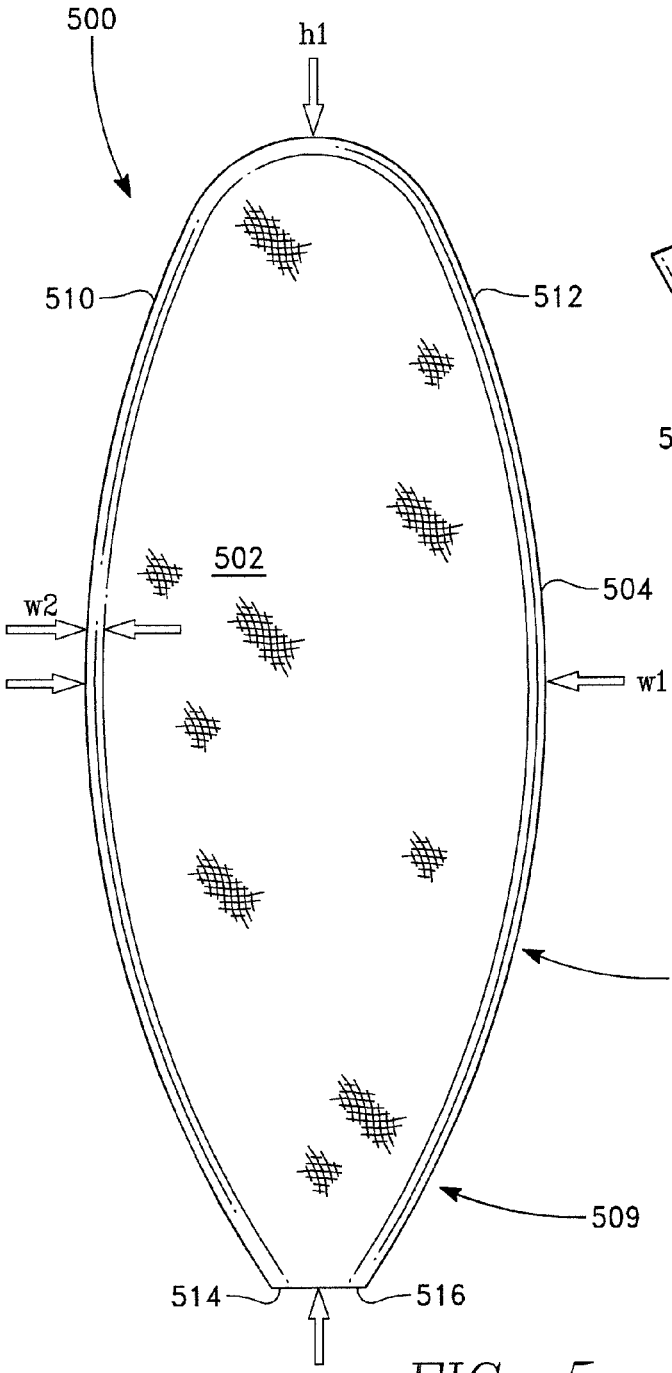
FIGS. 5 and 6 show panel portions of the sign of FIG. 1.
Figure 6:
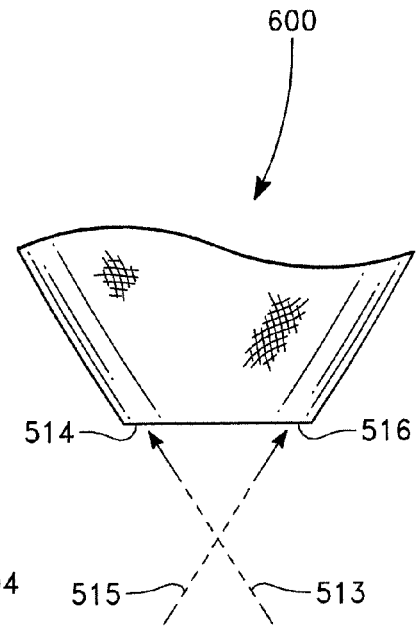

FIGS. 5 and 6 show a panel and panel portion with the arms removed from the coupling sleeves 500, 600. The panel 501 includes a web 502 and coupling 509. In this embodiment, the coupling is a sleeve 509 with substantially opposed portions 510, 512. The coupling sleeve affixed to the web 502 along a perimeter of the web 504. In various embodiments, and as shown here, the coupling sleeve is substantially continuous. Openings in the coupling sleeves near a bottom portion of the web 514, 516 provide insertion points for inserting the arms 513, 515.

The web is, in various embodiments, in the form of one or more of fabric, straps, cords, foil, and other suitable forms for transferring loads between the arms 110, 112. And, in various embodiments, the web is made from one or more of a) natural materials such as vegetable fibers, animal fibers, cotton, flax, wool, linen and the like, b) synthetic materials such as plastic, nylon, rayon, polyester, acetate, acrylic, carbon fiber, and the like, c) metals such as aluminum, copper, stainless steel, and the like, and d) other forms and materials persons of ordinary skill in the art would recognize as suited to a particular application.

In an embodiment, the web is in the form of a fabric made from materials including elastic material such as spandex (elastane). And, in some embodiments the fabric is a wind spilling fabric such as a fabric with pores occupying about 15 to 75% of the fabric's surface area.

The sleeve is, in various embodiments, in the form of one or more of fabric, straps, cords, foil, tubing, hooks, and other suitable forms for transferring loads between the arms 110, 112. And, in various embodiments, the sleeve is made from of one or more of a) natural materials such as vegetable fibers, animal fibers, cotton, flax, wool, linen and the like, b) synthetic materials such as plastic nylon, rayon, polyester, acetate, acrylic, carbon fiber, and the like, c) metals such as aluminum, copper, stainless steel, and the like, and d) other forms and materials persons of ordinary skill in the art would recognize as suited to a particular application. In an embodiment, the sleeve is tubular and is made from a synthetic fabric such as nylon fabric.

FIG. 7 shows an enlarged view of a yoke 700. As shown, two upraised yoke connectors 702, 704 have lower ends coupled or joined with the upper end of a lower connector 706. The yoke or a mid-plane of the yoke lies substantially in an x-y plane. In an embodiment, the connectors have a curved cross-section such as a circular, substantially hollow or tubular cross-section and average outer diameters of d7a, d7b and d7c corresponding to the yoke connectors 702, 704, 706. Various embodiments of the yoke provide for upraised connectors 702, 704 receiving respective arms 102, 104, or for arms receiving respective upraised connectors. The upraised connectors of the yoke describe a yoke angle, "θ."

Figure 8:
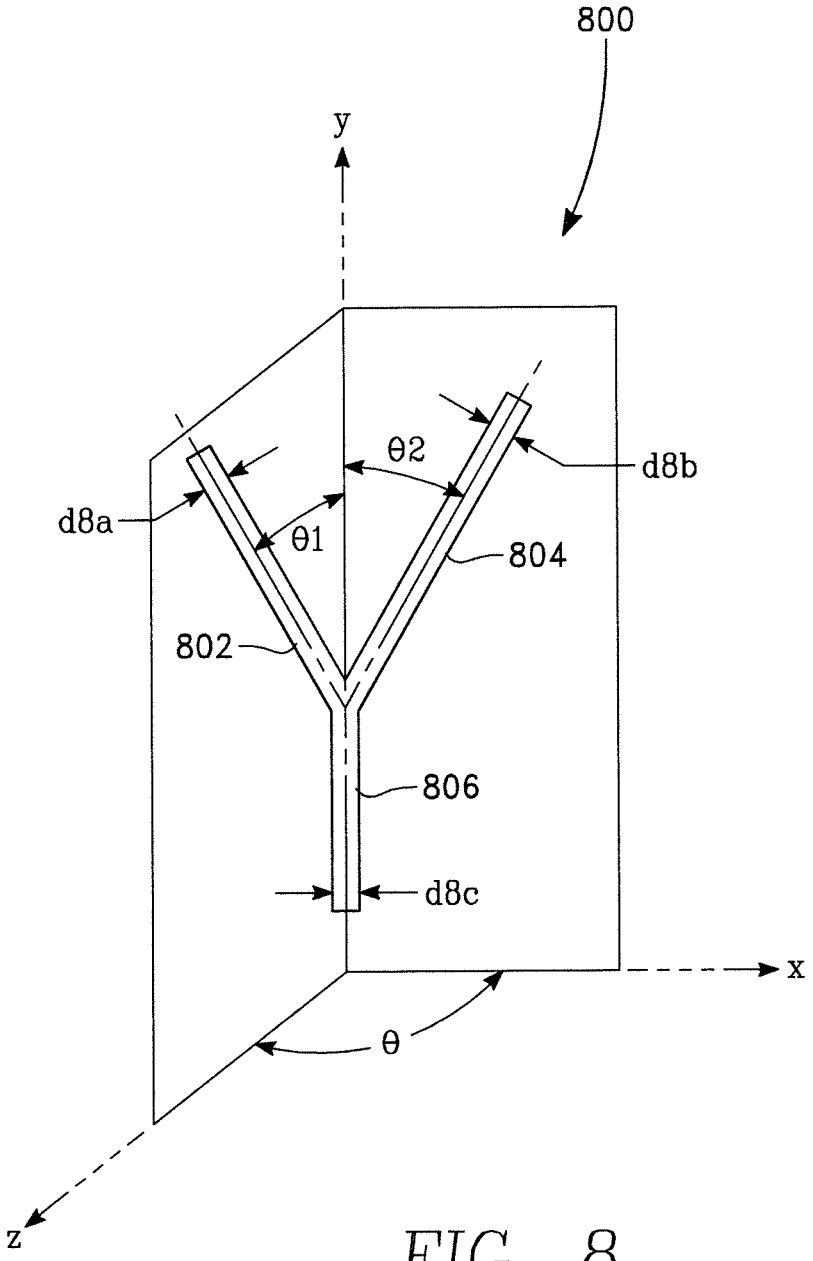
FIG. 8 shows another embodiment of a yoke for use with the dual arm sign of FIG. 1.

FIG. 8 shows an enlarged view of a yoke 800. As shown, two upraised yoke connectors 802, 804 have lower ends coupled or joined with the upper end of a lower connector 806. In an embodiment, the connectors have a curved cross-section such as a circular, substantially hollow or tubular cross-section and average outer diameters of d8a, d8b and d8c corresponding to the yoke connectors 802, 804, 806. Various embodiments of the yoke provide for upraised connectors 802, 804 receiving respective arms 102, 104, or for arms receiving respective upraised connectors.

It can be seen in FIG. 7 that the centerlines of the three connectors lie substantially in the x-y plane. However, in FIG. 8, the centerlines of the first and third connectors 802, 806 lie substantially in the y-z plane and the centerlines of the second and third connectors lie substantially in the x-y plane. The upraised connectors of the yoke describe two angles measured from the "y" axis; yoke angle θ1 relating to the first connector 802 and yoke angle θ2 relating to the second connector 804. As discussed infra, this "offset" yoke arrangement provides curvature, such as a "sail like" curvature, to the web.

Figure 9:
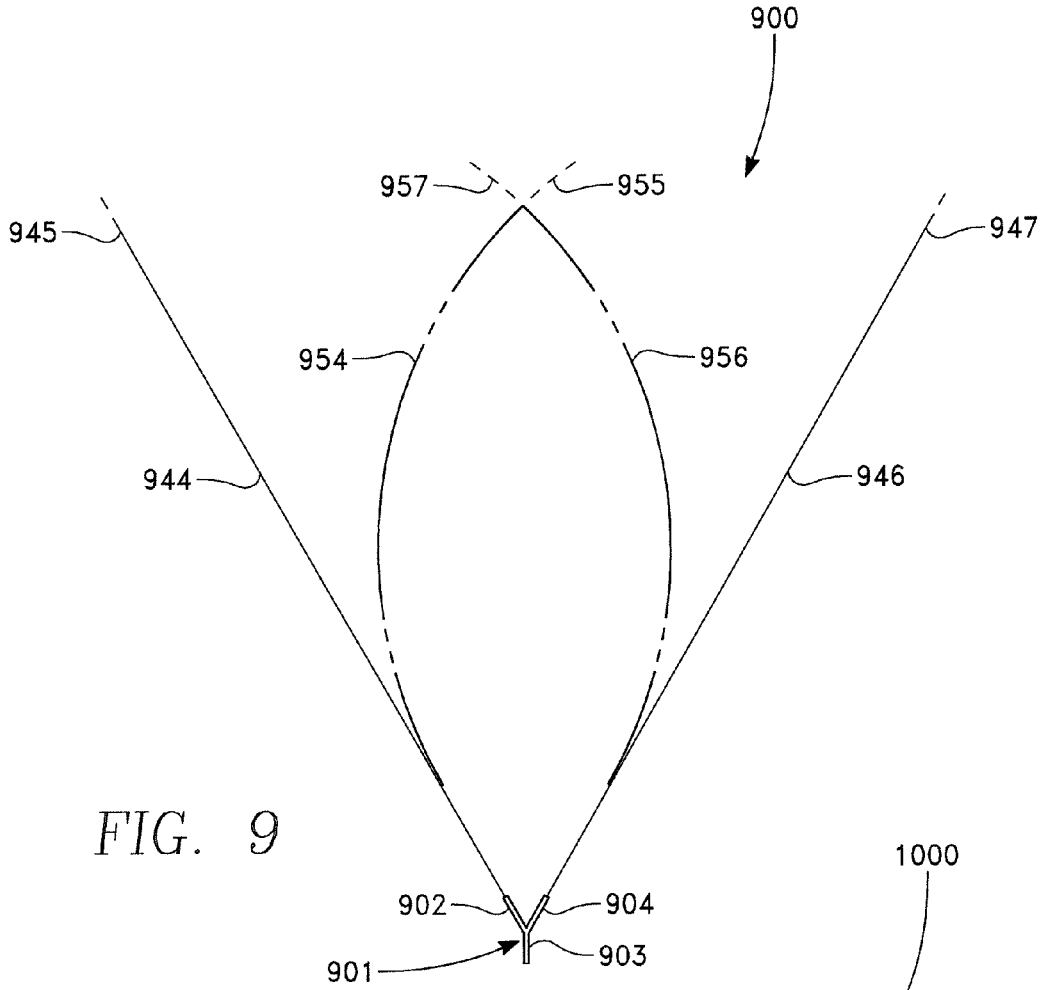
FIG. 9 shows arms of the sign of FIG. 1 before and after they are bowed.

FIG. 9 shows arms before and after they are bowed 900. In this embodiment, each arm 944 and 946 has an end received by respective upraised connectors 902, 904 of a yoke 901. When the arms are unbowed 944, 946, their centerlines 945, 947 radiate along diverging lines away from a yoke junction 903. In an embodiment, when the arms are bowed 954, 956, for example by fitting panel sleeves 510, 512 over the arms, their centerlines 955, 957 converge or tend to converge.

Figure 10:
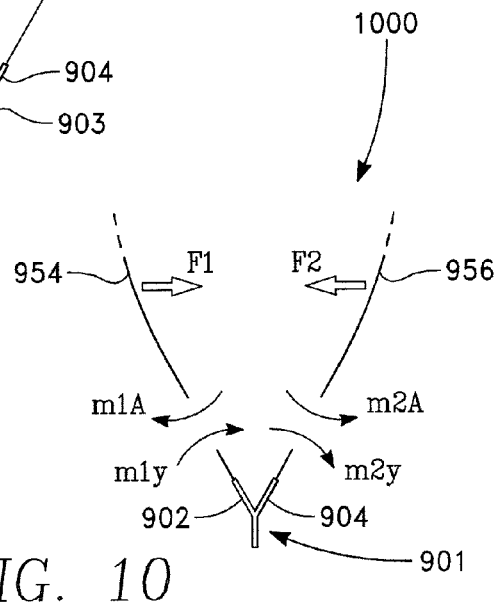
FIG. 10 shows a moment diagram for a yoke for use with the dual arm sign of FIG. 1.

FIG. 10 shows a yoke moment diagram 1000. Here, the arms 954, 956 are bowed, for example by fitting panel sleeves 510, 512 over the arms. The yoke connections 902, 904 resist moments M1Y, M2Y applied by respective bowed arms M1A, M2A. To the extent the yoke geometry is maintained, the arms tend to remain bowed under the influence of forces F1, F2 tending to prevent separation of the arms. In various embodiments, the stiffness of each arm is greater near the yoke than near the free end of the panel.

As shown in FIG. 5, the panel has a height and a width w1. The coupling 510, 512 has a width w2 such that (w1−(2×w2)) is substantially equal to the web width. In various embodiments, an aspect ratio of the panel (h1/w1) is in the range of about 2.0 to 4.0. In some embodiments an aspect ratio of the panel is in the range of about 2.5 to 3.5. For a given aspect ratio, the taller the panel, the larger the load the panel applies to the arms and the larger the load the arms apply to the yoke.

In a first embodiment, the panel of the dual arm sign 101 has an aspect ratio (h1/w1) of about 2.7. Here, the arms are made of one or more resilient, substantially hollow tubes. An exemplary arm has substantially smooth taper from an outside diameter of about one inch at the arm base to an outside diameter of about one quarter of an inch near the arm tip. Another exemplary arm has several sections, each section having a substantially constant outside diameter, the largest diameter section being the base section and the smallest diameter section being the tip section. For a multi-section arm with four sections, the outside diameters of the sections are about one inch at the base section, five eights of an inch at a first intermediate section, three eights of an inch at a second intermediate section, and one quarter of an inch at the tip section. In each case, the wall thickness of the arm tubes are chosen for durability including resistance to crushing as at the base/yoke interface and according to the application.

In a first embodiment, the panel of a dual arm sign 101 has an aspect ratio (w1/w2) of about 2.7 and a height h1 of about 168 inches. Here, the arms are made of one or more resilient, substantially hollow tubes such as steel tubes. An exemplary arm has substantially smooth taper from an outside diameter of about one inch at the arm base to an outside diameter of about one quarter of an inch near the arm tip. Another exemplary arm has several sections, each section having a substantially constant outside diameter, the largest diameter section being the base section and the smallest diameter section being the tip section. For a multi-section arm with four sections, the outside diameters of the sections are about one inch at the base section, five eights of an inch at a first intermediate section, three eights of an inch at a second intermediate section, and one quarter of an inch at the tip section. In each case, the wall thickness of the arm tubes are chosen for durability including resistance to crushing as at the base/yoke interface and according to the application.

In a second embodiment, the panel of a dual arm sign 101 has an aspect ratio (w1/w2) of about 3.1 and a height of about 128 inches. Arms similar to those above may be used in this embodiment, the strength required of the arms likely being somewhat less given the panel dimensions.

Figure 11:
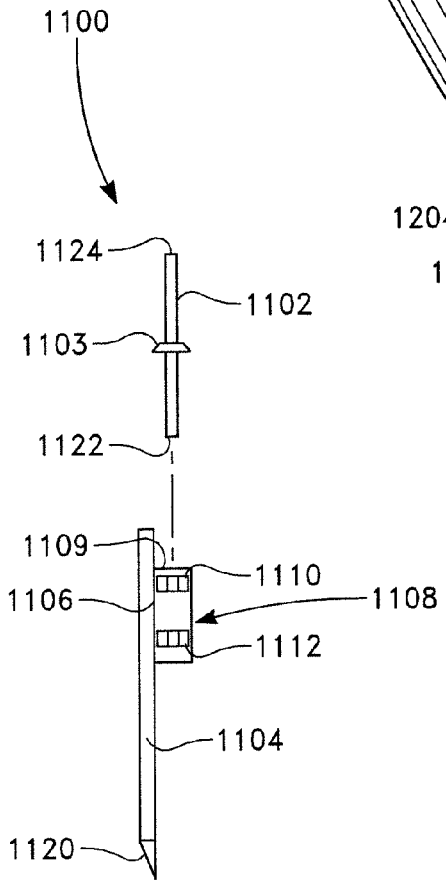
FIGS. 11 and 12 show a mount for the dual arm sign of FIG. 1.
Figure 12:
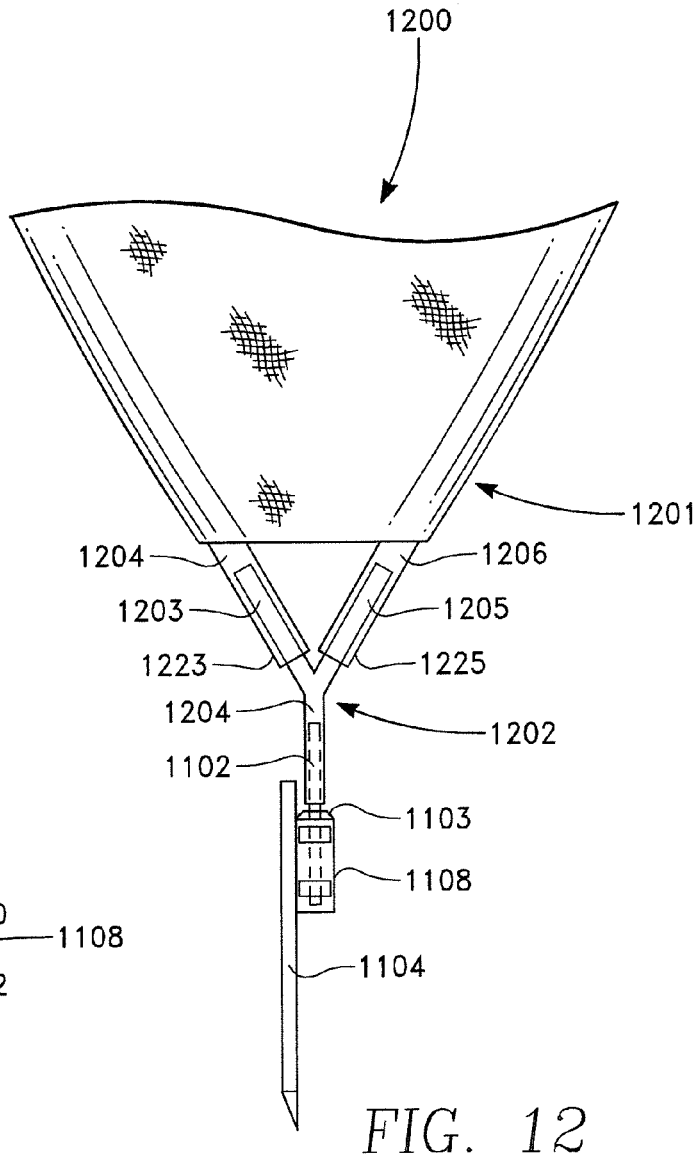

FIGS. 11 and 12 show a mount for the dual arm sign 1100, 1200. An extension member first support 1108 is coupled, such as by welding 1106, to a fixture designed to support forces from the panel, arms and yoke such as an extension member second support 1104. In some embodiments, the extension member second support is a stake having a suitably prepared end 1120.

The extension member first support 1108 is for receiving a lower end 1122 of an elongated extension member or rod 1102; in some embodiments, the extension member has a stop collar between its ends 1103 (as shown). In various embodiments, the extension member first support includes means for receiving the extension member lower end including one or more of a borehole 1109, a first anti-friction bearing 1110 and a second anti-friction bearing 1112. Suitable anti-friction bearings include spherical roller bearings and tapered roller bearings capable of supporting side loads such as the weight of the panel 101, arms 104, 106 and yoke 108.

In some embodiments, the extension member 1102 is not a separate part, but is formed by the lower connector of the yoke 1204. In various embodiments, at least some of the mount parts are made from one or more of natural materials, metals, plastics, and composites such as wood, aluminum, steel, stainless steel, high density polyethylene, nylon, fiberglass, and carbon fiber with a suitable matrix such as epoxy.

FIG. 12 shows the mount supporting a dual arm sigh. A yoke 1202 is positioned between a panel 1201 and the mount 1100. The yoke is coupled to the extension member second support 1110 via the extension member 1102 which is inserted in the lower connector of the yoke 1204. Notably, in some embodiments tubular parts such as the yoke connectors have inserts to provide bearing points for mating parts such as an end 1124 of the extension rod. The yoke is coupled to the panel via the arms 1204, 1206. A lower end of each arm 1223, 1225 receives a respective upstanding connector 1203, 1205. As persons of ordinary skill will appreciate, mating of tubular members is accomplished according to application with numerous embodiments including connectors such as male/female joints, female/male joints; fixed joints such as welded, adhesive, and fastened joints; and, articulated joints such as hinges, spherical joints, and the like.

Figure 13:
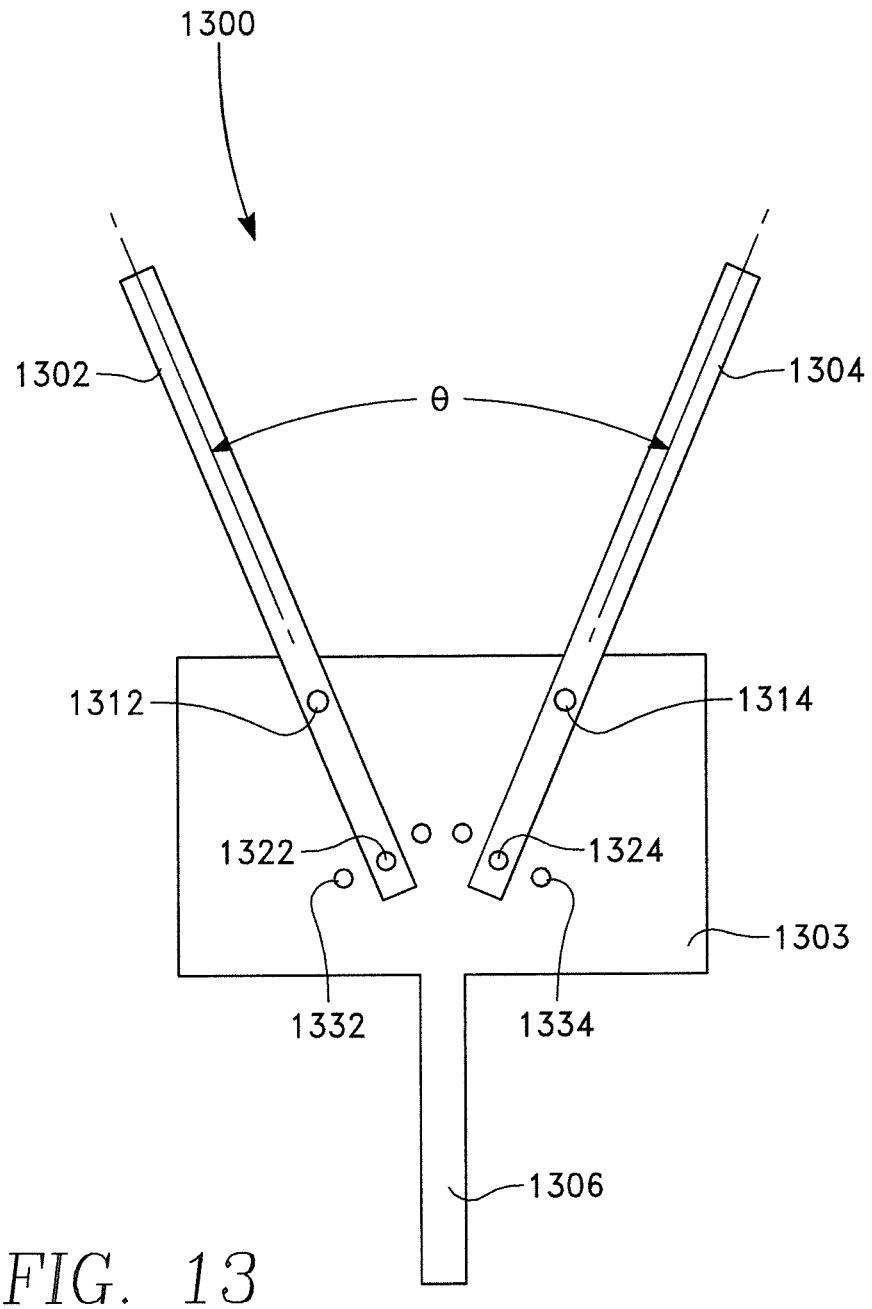
FIG. 13 shows an adjustable yoke for use with the dual arm sign of FIG. 1.

FIG. 13 shows an adjustable yoke 1300. As shown, the yoke includes two upraised yoke connectors 1302, 1304 and a lower connector 1306. The upraised connectors have respective central pivotal couplings 1312, 1314 with a yoke center part 1303. The pivotal couplings may be formed by any suitable means known to persons of ordinary skill in the art, such as aligned holes with an interengaged pivot pin. In some embodiments, one upraised connector is pivoted with respect to the other upraised connector such as where a pivotal coupling interengages the upraised connectors or where a pivotal coupling interengages the upraised connectors via intervening parts such as a yoke center part.

The angle θ between the upraised connectors is adjustable using removable fixed couplings. The removable fixed couplings may be formed by any suitable means known to persons of ordinary skill in the art, such as holes in the connectors 1322, 1324 and mating holes in the yoke center plate 1332, 1334 through which a fixing pin (not shown for clarity) is located.

As persons of ordinary skill in the art will appreciate, the yoke coupling design provides for an adjustable angle θ and may be implemented with pins, hinges, latches, bearings, pawls, springs and the like. In each case, the design provides for relative motion of one of the yoke's upraised connectors 1302, 1304 with respect to the other upraised connector.

In operation the present invention 100 provides an upstanding panel. The invention is useful for, inter alia, conveying a message to onlookers. In various embodiments, first and second arms 104, 106 are inserted in the couplings of a panel 110, 112 such as a panel substantially in the shape of an upstanding oval 101, the panel including a web 102. Adjacent connectors of the yoke 1203, 1205 are inserted in the adjacent ends of the arms 1223, 1225, the yoke applying moments to the adjacent ends of the arms such that the arms take on a convex bow and stretch the panel therebetween.

In alternate embodiments, the panel height h1 and aspect ratio h1/w1 vary. In various embodiments, changing panel height and/or aspect ratio requires a particular yoke angle θ to achieve an upright and/or fully stretched web 102. Use of the adjustable yoke of FIG. 13 provides an adjustable yoke angle θ to accommodate different panels 101 by moving the fixed pin coupling(s).

The sign 100 is not rotatable in some embodiments. In a non-rotating embodiment, the lower connection of the yoke 1204 is fixed to a non-rotating part such as a fixed mounting point, plate or stake.

The sign 100 is rotatable in some embodiments. In a rotating embodiment, rotation of the sign is enabled by rotatably mounting the lower connector of the yoke 1204. Rotatable mountings include fitting the lower connector in a socket and fitting the lower connector over a rod or stake.

In another rotating embodiment, rotation of the sign 100 is enabled by coupling the yoke 700 between the arms 1204, 1206 and the extension member 1102, the extension member being rotatably inserted in the extension member first support 1108. In an embodiment, one or two anti-friction bearings 1110, 1112 are utilized as described above to reduce resistance to rotation.

In yet another rotating embodiment, rotation of the sign 100 is enabled by coupling the yoke 800 between the arms 1204, 1206 and the extension member 1102, the extension member being rotatably inserted in the extension member first support 1108. The offset arrangement of the yoke's upright connections 802, 804 increases the curvature of the web 102 and enhances the rotating effect of wind impinging on and/or redirected by the web. In an embodiment, one or two anti-friction bearings 1110, 1112 are utilized as described above to reduce resistance to rotation.

While various embodiments of the present invention have been described above, it should be understood that they have been presented by way of example only, and not limitation. It will be apparent to those skilled in the art that various changes in the form and details can be made without departing from the spirit and scope of the invention. As such, the breadth and scope of the present invention should not be limited by the above-described exemplary embodiments, but should be defined only in accordance with the following claims and equivalents thereof.

What is claimed is:

1. A sign comprising:

first and second resilient arms;

the arms flanking a panel substantially in the shape of an upstanding oval;

the arms operable to apply stretching forces to the panel;

at an end of the panel, a yoke applying moments to adjacent ends of the arms;

generally opposed to the yoke end of the panel, a free end of the panel; and, the stiffness of each arm being greater near the yoke than near the free end of the panel.

2. The sign of claim 1 wherein the arms have a generally decreasing outer diameter when moving from the panel yoke end to the panel free end.

3. The sign of claim 2 wherein the arms include multiple adjoining sections of different outside diameters.

4. The sign of claim 3 wherein the arms are continuously tapered.

5. The sign of claim 2 wherein the panel includes a central web and web couplings.

6. The sign of claim 1 further comprising a rotatable coupling interposed between the yoke and a fixture designed to support the panel, arms and yoke.

7. The sign of claim 6 further comprising a panel web and web curves induced when the yoke is offset.

8. The sign of claim 7 wherein the rotatable coupling includes an anti-friction bearing.

9. The sign of claim 8 wherein the web couplings consist of a substantially continuous sleeve attached to the perimeter of the web.

10. The sign of claim 9 wherein the web is a wind spilling fabric.

11. A method of drawing attention to a sign comprising the steps of:

providing a yoke with two upraised connectors and one lower connector, the upraised connectors engaging the ends of respective upraised resilient arms;

bowing the upraised arms with a pliable fabric stretched therebetween;

increasing sign animation by decreasing resistance of a free and upraised end of the sign to wind excited motion by decreasing the arm's stiffness along its length and in the direction of sign's free end; and, increasing sign animation by interconnecting the lower yoke connector with a rotatable coupling.

12. The method of claim 11 further comprising the step of increasing sign animation by inducing curves in the fabric with an offset yoke.

13. A method of providing a sign comprising the steps of:

providing a yoke with two upraised connectors and one lower connector, the upraised connectors engaging the ends of respective upraised resilient arms;

pivoting one of the upraised connectors with respect to the other upraised connector, thereby adjusting the bowing in the upraised arms for stretching a pliable fabric therebetween;

increasing sign animation by decreasing resistance of a free and upraised end of the sign to wind excited motion by decreasing the arm's stiffness along its length and in the direction of sign's free end; and, increasing sign animation by interconnecting the lower yoke connector with a rotatable coupling.

* * * * *